US005242063A

United States Patent [19]

Ericksen et al.

[11] Patent Number: 5,242,063

[45] Date of Patent: Sep. 7, 1993

[54] BATHROOM VERTICAL SURFACE ORGANIZER

[76] Inventors: Amy C. Ericksen; Kirk A. Ericksen, both of 2005 182nd Ave. NE., Redmond, Wash. 98052

[21] Appl. No.: 753,609

[22] Filed: Aug. 30, 1991

[51] Int. Cl.[5] ..... A47F 5/00

[52] U.S. Cl. ..... 211/87; 248/205.2; 248/206.3; 211/89; D6/525

[58] Field of Search ..... 211/88, 60.1, 70.6, 211/87, 89; D6/524, 525, 540, 541, 545, 532, 536, 553

[56] References Cited

U.S. PATENT DOCUMENTS

| | | | |
|---|---|---|---|
| 3,869,183 | 3/1975 | Frank | D6/525 X |
| 4,150,869 | 4/1979 | Hansen | D6/525 X |
| 4,984,760 | 1/1991 | Cohn et al. | 248/206.3 X |
| 5,027,960 | 7/1991 | Rainville | 211/118 |
| 5,082,111 | 1/1992 | Corbitt et al. | 211/70.6 X |

*Primary Examiner*—Robert W. Gibson, Jr.
*Attorney, Agent, or Firm*—Craine & Jackson

[57] ABSTRACT

An organizing device for holding objects on a vertical surface, particularly well suited for a vertical surface near a bathtub or shower stall. In the preferred embodiment, the device includes a relatively large base member selectively attached to the vertical surface. Suction cups are used to attached the base member in different locations on the vertical surface without causing damage thereto. The base member includes an inner semi-rigid support member and an outer loop connector surface to which a plurality of object connectors may be selectively attached during use. In the preferred embodiment, the object connectors are strap connectors which are placed securely around an object. Each strap connector has a complimentary hook connector surface which enables the strap connector to be selectively attached to the base member while simultaneously attached to the object. By pressing the strap connector into the base member, the user is thereby able to selectively attach the object to the vertical surface. The base member has sufficient size and strength and the strap connectors are adjustable and available in different sizes and shapes so that various objects may be attached to the base member at the same time.

18 Claims, 5 Drawing Sheets

BATHROOM VERTICAL SURFACE ORGANIZER

TECHNICAL FIELD

The invention disclosed herein relates generally to devices used to hold objects on a vertical surface. More particularly, this invention relates to such devices which may be selectively and removably attached to the vertical surface and which holds and stores different objects.

BACKGROUND ART

It has long been known that the area around a bathtub or shower stall for holding and storing containers for shampoo, hair conditioners, and other objects is limited. Today, most individuals store these containers or objects on rack structures supported by the shower head, or on small ledges located in the corners and sides of the bathtub or shower stall. Unfortunately, the amount of space available in such structures or locations is limited and not well suited for all individuals. In addition, such structures and locations are not well suited for holding a large number of different containers or objects commonly used while bathing or showering.

In addition to not having sufficient storage space, handling such containers or objects while bathing or showering can also be difficult. This is especially true when the user's hands are wet or when his eyes are closed. These factors often cause the user to mishandle or drop the container which may cause injury or breakage.

It is a general object of the present invention to provide a organizing device that can be easily attached to a vertical surface near a bathtub or a shower stall that can conveniently hold and store a plurality of containers or objects used while bathing or showering.

It is another object of the present invention to provide such a device that can be easily and conveniently attached in different locations to the vertical surface without requiring modification of the vertical surface or damage thereto.

It is further object of the present invention to provide such a device that can help the user handle objects while bathing or showering.

It is a still further object of the present invention to provide such a device that is inexpensive to manufacture and easy to use.

DISCLOSURE OF INVENTION

The foregoing objects are met by the present invention which provides an organizing device used to store various containers or objects on a vertical surface located adjacent to a bathtub or shower stall. Although, the device is described as being used on such vertical surfaces, it should be understood that it can be used on other surfaces and in other locations.

The device is used to organize various objects commonly used while bathing or showering, such as shampoo or hair condition containers, brushes, toys, and etc., by holding and storing such objects in one convenient location. The device is designed to be used on a vertical surface in the bath or shower area and is, therefore, made of water and mildew resistant material. It is also designed to be used either in a permanent or temporarily manner in different locations on the vertical surface without requiring modification or causing damage to the vertical surface. The device is also designed to be easily attached to different locations on the vertical surface for easy use by different users, such as adults or small children.

The device itself comprises a relatively large base member which may be selectively and removably attached to the vertical surface by a surface attachment means. The surface attachment means is attached to the inside surface of the base member which enables the base member to be selectively attached to vertical surfaces having different textures, such as fiberglass, tile, or glass. When desired, the user may move the base member to different locations on the vertical surface by easily disconnecting and re-connecting the surface attachment means to the vertical surface. The surface attachment means is designed to securely hold the base member having a plurality of objects attached thereto on the vertical surface for long periods.

The base member may be manufactured in different shapes and sizes for different uses. A connector engagement surface is located on the outside surface of the base member which enables various object connectors to be selectively attached and detached from the base member. An object connector is attached to an object which can then be selectively held, removed, or stored on the base member. An adjustment means is provided with each object connector which enables each object connector to be used with different objects.

Alternative embodiments of the device are also provided for use on angled or curved-shaped vertical surfaces. Also, optional mirror and soap dish connectors are provided making the device a complete organizing unit for the bath or shower area.

Using the above device a method of organizing various objects on a vertical surface in a bath or shower is also provided.

BEST MODE FOR CARRYING OUT THE INVENTION

Figure 1:
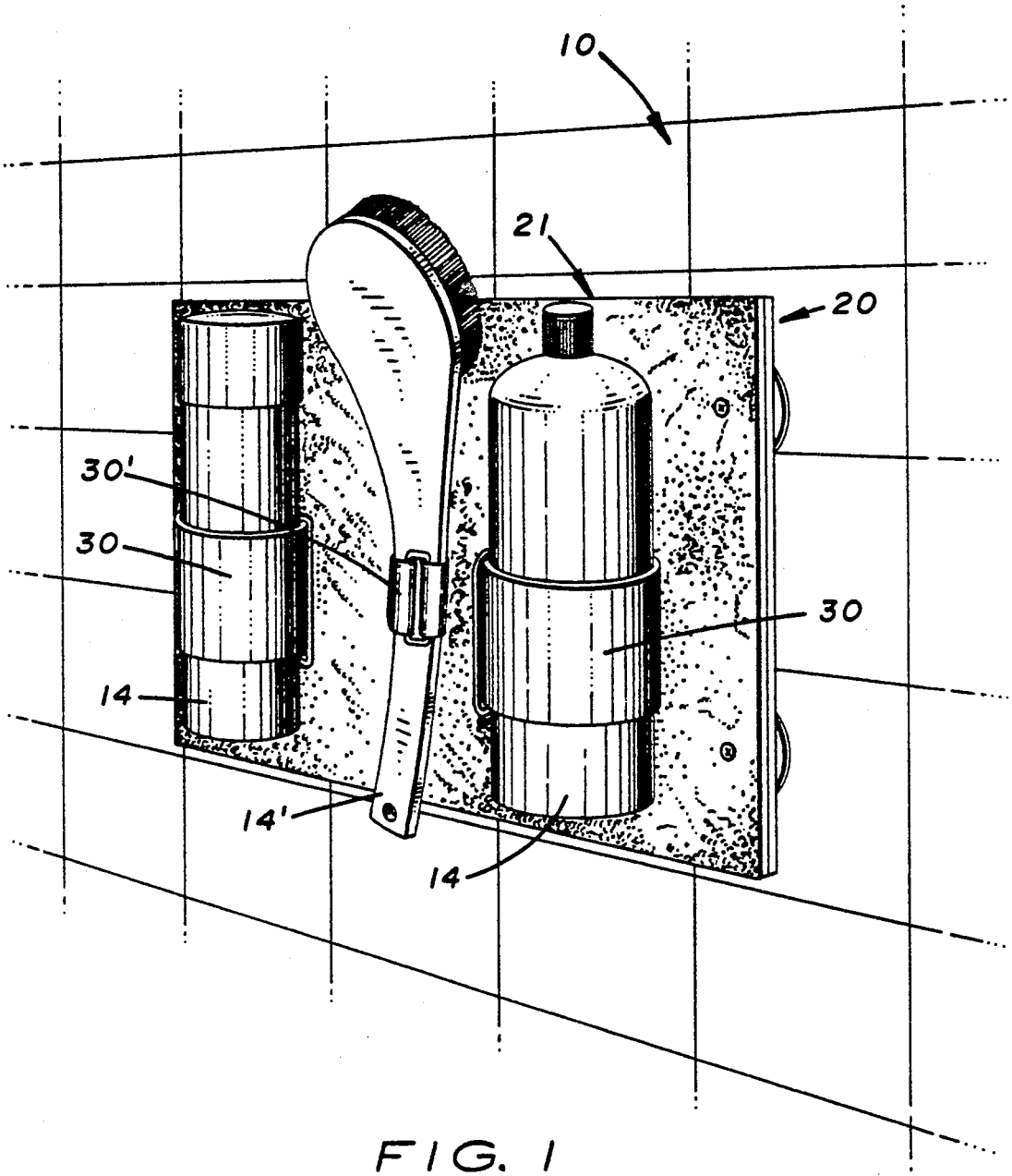
FIG. 1 is a perspective view of an embodiment of the present invention attached to a vertical surface with various objects attached thereto.

In FIG. 1 is depicted a first embodiment of the organizing device 20, shown attached to a vertical surface 10, surrounding a shower or bathtub, and used to hold various containers or objects 14 (hereinafter referred to generally as objects 14) thereto. The device 20 comprises a base member 21 capable of being removably attached to the vertical surface 10 by a surface attachment means. The outside surface of the base member 21 is a connector engagement surface which enables a plurality of object connectors comprising strap connectors 30 which adjustably attached to objects 14 which then may be removably attached to the base member 21 Objects 14 are then securely held on the base member 21 until selectively removed by the user.

Figure 2:
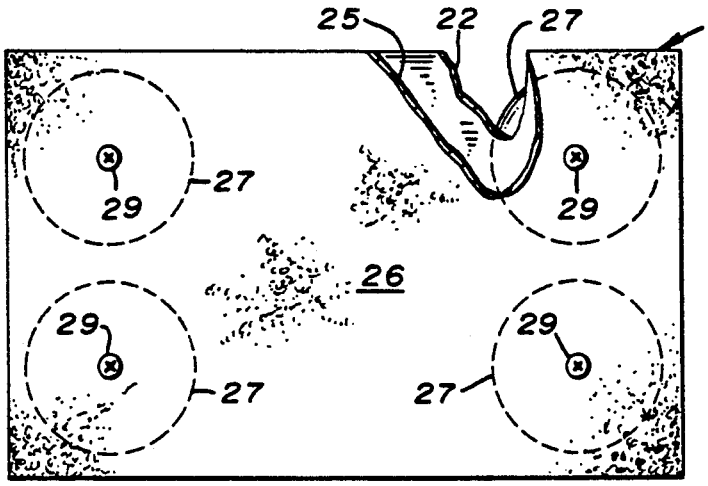
FIG. 2 is a plan, sectional view, partial broken away, of the base member shown in FIG. 1
Figure 3:
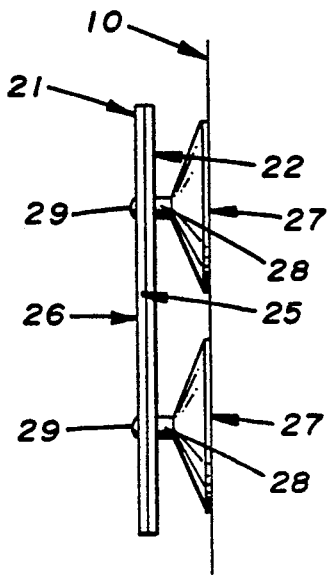
FIG. 3 is a side elevational view of the base member.
Figure 4:
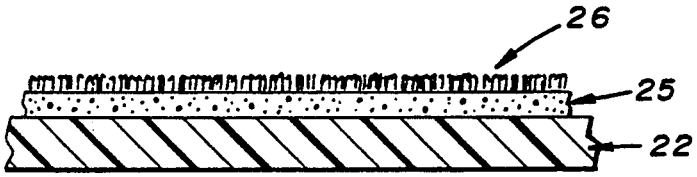
FIG. 4 is a partial, sectional, elevational view of the base member.

As shown in FIGS. 2 and 3, the base member 21 is a square or rectangular structure comprising a planar, semi-rigid, inner support member 22 covered entirely by a connector engagement surface. The support member 22 is made of durable, water and mildew-resistant, lightweight material capable of withstanding the downward gravitational forces exerted by objects 14 when attached thereto, and forces exerted by the user when attaching and removing objects 14 from the base member 21 during normal use. In the preferred embodiment, support member 22 is made to support at least three objects 14 each weighing approximately three pounds.

Support member 22 is designed to be sufficiently flexibly so that the user can easily attach and remove various objects 14 from the base member 21 without disconnecting the base member 21 from the vertical surface 10. In the preferred embodiment, support member 22 is made of acrylonitrile butadiene styrene resin material, also known commonly as ABS, measuring approximately ¼ inch thick. Other types of materials providing the base member 21 the same characteristics may also be used. The connector engagement surface comprises a foam material 25 attached along its inner surface to the outside surface of support member 22 by a suitable adhesive (not shown). Foam material 25 between support member 22 and the first connector surface 26 provides additional flexibility which enables the user to more easily attach and remove objects 14 from the base member 21.

Foam material 25 , which is made of durable, water and mildew resistant material, such as nylon, has an outer first loop connector surface 26. In the preferred embodiment, the foam material 25 and first loop connector surface 26 is a single structure and sold under the trademark, "3001 VELCRO TM". Foam material 25 and first loop connector surface 26 may be manufactured by adhesively attaching two separate layers together.

In the preferred embodiment, the base member 21 measures approximately 10 to 15 inches in length and 5 to 8 inches in width, and is designed to be used with a plurality of strap connectors 30. The actual number of strap connectors 30 used can vary depending upon the size of the base member 21 and the number, size, and weight of the objects 14 to be attached.

As mentioned above, a surface attachment means is used to removably attach the base member 21 to the vertical surface 10. In the preferred embodiment, the surface attachment means comprises four suction cups 27 attached to the inside surface of support member 22. Each suction cup 27 is manufactured to be attached to any relatively flat, smooth vertical surface 10. Each suction cup 27 is approximately two inches in diameter and made of rubber or some other suitable material. Each suction cup 27 is attached approximately one and one-half inches from each corner of the base member 21 with water and corrosive resistant threaded connectors 29 which extend through the base member 21 and attached to threaded bores (not shown) located on the neck portion 28 of each suction cup 27. The head of the threaded connector 29 may be covered by the foam material 25 and first loop connector surface 26 or left exposed (shown). The edge of each suction cup 27 is located relatively close to the adjacent edges of the base member 2 thereby enabling the user to easily lift the edge of the suction cup 27 to detach the base member 21 from the vertical surface 10. Also, the length of the neck portion 28 of suction cup 27 is sufficient so that the distance between the inside surface of the support member 22 and the vertical surface 10 is approximately one-half inch. This distance enables the base member 21 to be pressed firmly towards the vertical surface 10 when attaching the base member 21 to the vertical surface 10 and when attaching various objects 14 thereto. The actual number, size, and location of the suction cups 27 attached to the base member 21 may be varied, of course, depending upon the intended use of device 20.

Figure 5:
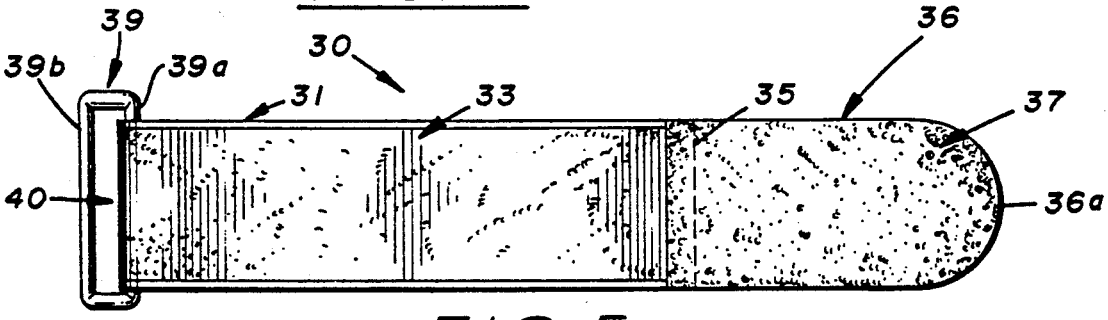
FIG. 5 is a plan view of a strap connector.
Figure 6:
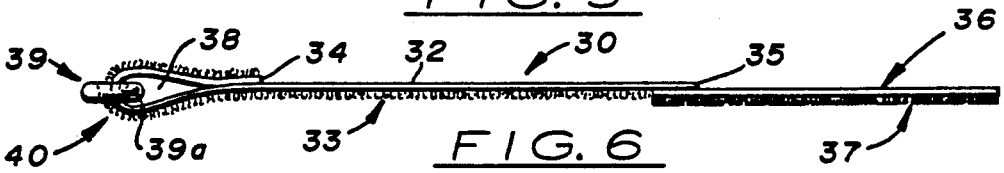
FIG. 6 is a side elevational view of the strap connector shown in FIG. 5.

As illustrated in FIG. 1 and as mentioned above, a plurality of object connectors are used to removably attach container objects 14 and other miscellaneous objects 14' to the base member 21. Each object connector comprises a strap connector 30 capable of being manufactured in different lengths and widths for use with different container objects 14 or miscellaneous objects 14'. As shown more clearly in FIGS. 5–7, each strap connector 30 comprises an elongated wrap structure 31 having an inside surface 32, an outside hook connector surface 33, a first end 34, and a second end 35. Hook connector surface 33 is capable of being interconnected with the first loop connector surface 26 located on base member 21. Attached to the wrap structure 31 near the second end 35 of the wrap structure 31 is a strip 36 having a second loop connector surface 37 which is similar to the first loop connector surface 26 on the base member 21. Strip 36 is attached to the wrap structure 31 so that the second loop connector surface 37 is located on the said side of the wrap structure 31 as hook connector surface 33.

An adjustment means is attached to each strap connector 30 which enables each strap connector 30 to be adjustably attached to objects 14. In the embodiment shown, the adjustment means comprises a ring member 39 made of plastic or some other suitable material. Ring member 39 has two opposite first and second leg members 39*a* and 39*b*, respectively, and a central passageway 40. Central passageway 40 is manufactured slightly larger than the width of strap connector 30 thereby enabling the distal end 36(*a*) of strip 36 be extend through.

During assembly of each strap connector 30, the first end 34 of the wrap structure 31 is extended through the central passageway 40 and loosely wrapped around first leg 39*a*. The first end 34 is then welded or adhesively attached to the inside surface 32 of strap connector 30. A space 38 is created around the first leg 39*a* which allows the ring structure 39 to pivot loosely around first leg 39*a*.

Figure 7:
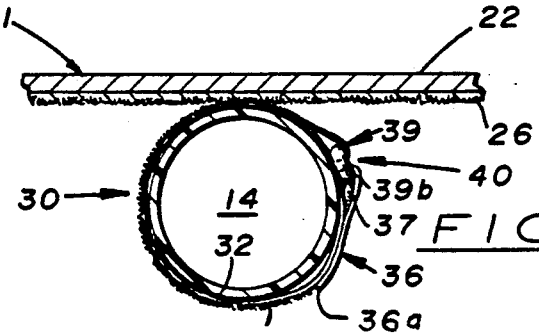
FIG. 7 is a partial plan, sectional view of the strap connector attached to an object and used to attach the object to the base member.

As shown in FIG. 7, the strap connector 30 is adjustably attached to the desired object 14 by first wrapping the strap connector 30 around the object 14 so that inside surface 32 is placed against the object 14. The distal end 36*a* of the strip 36 is then extended through the central passageway 40 and back around the second leg 39*b* and pulled tightly to cinch the strap connector 30 around the object 14. The second loop connector surface 37 is then pressed into the hook connector surface 33 located on the wrap structure 31 to hold the strap connector 30 around the object 14. By pushing or pulling the strap structure 30 through the ring member 39 and my adjusting the relative positions on of the second loop connector surface 37 and the first hook connector surface 26, the user my adjust the tightness of the strap structure 30 around the object 14. With wet objects or objects having smooth outer surfaces, for example, the adjustability feature of the strap connector 30 allows it to be cinched tighter around the object 14 than normally required.

After the strap connector 30 has been securely attached to the object 14, the object 14 may be attached to the base member 21. The user must first rotate the object 14 so that the exposed portion of the hook connector surface 33 is facing the first loop connector surface 26 on the base member 21. The user then firmly presses the object 14 into base member 21 to interconnect the hook connector surface 33 with the first loop connector surface 26. To remove the object 14 from the base member 21, the user grabs and pulls the object 14 perpendicularly from the base member 21. Because the entire surface of the base member 21 is covered with the first loop connector surface 26, the user is not required to first locate a particular location or on the base member 21 before attaching an object 14. This feature allows the user to attach and remove objects 14 from the base member 21 with little or no visual ability or coordination.

As shown in FIG. 1, strap connectors 30 can be manufactured in different sizes. For attaching cylindrical-shaped shampoo or hair conditioner containers 14, which typically measure approximately 2 inches in diameter, the strap connectors 30 measure approximately 10 inches in length and 2 inches in width. For use with smaller containers or other miscellaneous objects 14', such as a brush (shown), a smaller strap connector 30' may be used measuring approximately 5 inches in length and 1 inch in width.

Figure 8:
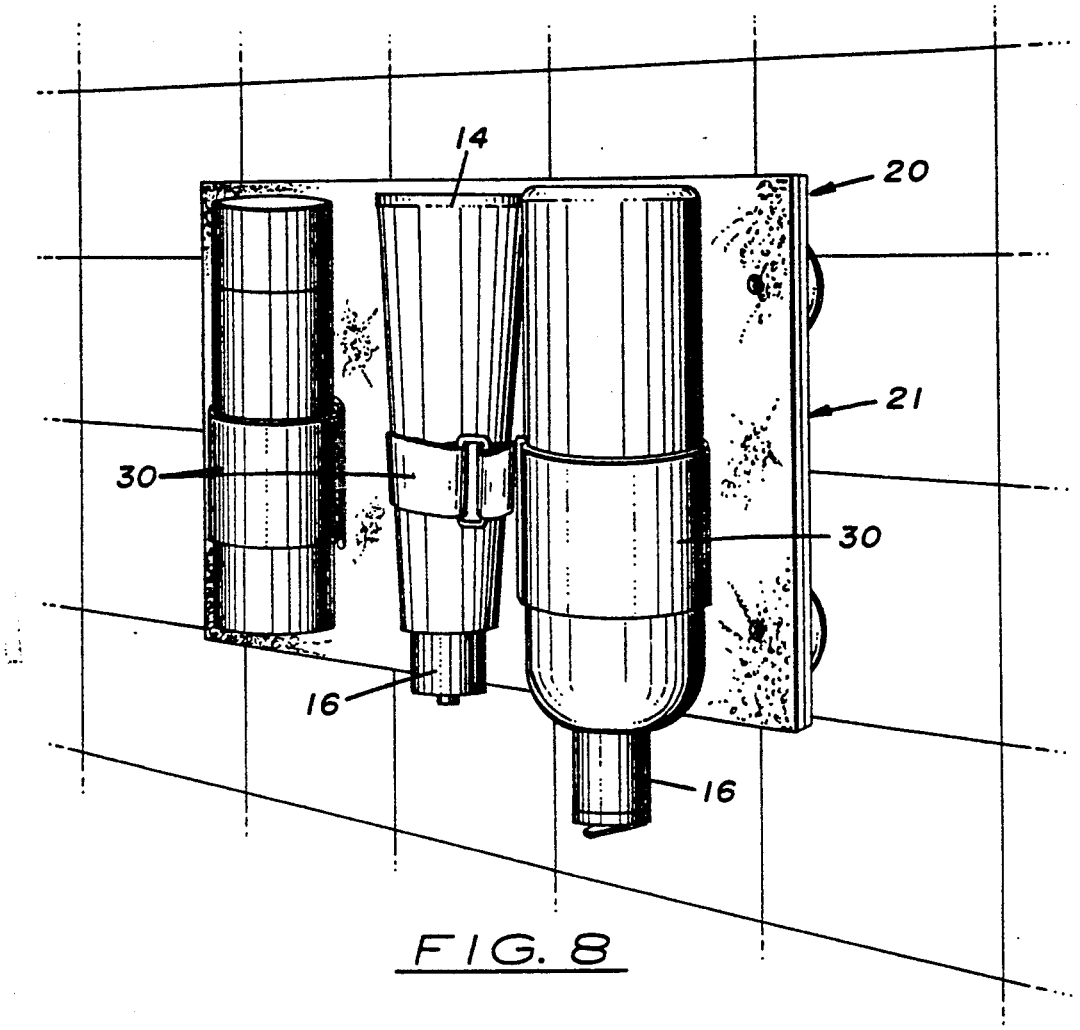
FIG. 8 is a perspective view of the embodiment shown in FIG. 1 showing various containers attached to the base member in an upright and upside-down manner.

One advantage for using strap connectors 30, is that they reduce mishandling on the object 14 while bathing or showering by providing a gripping surface. Another advantage is that each can be adjusted by the user for attaching different objects 14 to the base member 21. Further, because the hook connector surface 33 may be interconnected With the first loop connector surface 26 on the base member 21 in any direction, objects 14 may be securely attached and held in any desirable position on the base member 21. For example as shown in FIG. 8, the strap connectors 30 can be used to hold shampoos and hair conditioners object containers 14 in an inverted, upside-down manner on the base member 21. Since many of these object containers have self-dispensing caps 16, storing them in an upside-down manner as shown, enables the user to dispense the material contained therein without detaching the container object 14 from the base member 21. In some instances, the user is able to dispense the material using one hand.

Figure 9:
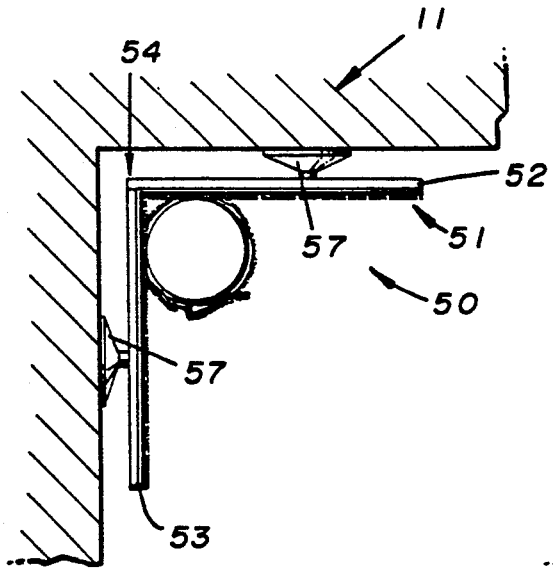
FIG. 9 is a plan view showing an alternative embodiment of the device using an angled base member.

As mentioned above, the base member 21 may be manufactured in different shapes and sizes. For example, FIG. 9 shows a device 50 having an angled structured base member 51 designed to fit into an angled vertical surface 11 Base member 51 comprise two first and second planar sections 52 and 53, respectively, attached together at substantially 90 degrees at a joint 54. Base member 51 is similar in construction to base member 21 with each planar section 52 and 53 having a support member and connector engagement surface (not shown). A plurality of suction cups 57 are used to attach base member 51 to the surface 11. In the preferred embodiment, four suction cups 57 are used with one pair of suction cups 57 located centrally on each planar section 52 and 53 to provide greater support near joint 54. An advantage of using base member 51 over base member 21 is that base member 51 provides greater contact surface for the strap connectors 30 for attaching heavier containers to the device 50.

Figure 10:
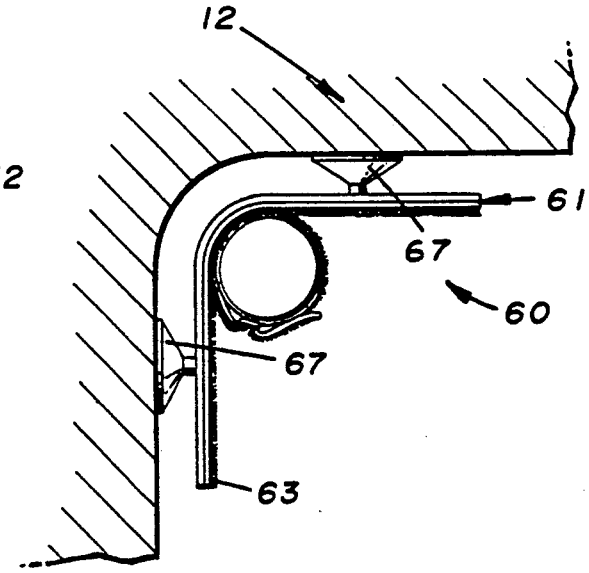
FIG. 10 is a plan view showing an alternative embodiment of the device using a curved base member.

FIG. 10 shows another embodiment of the invention, device 60 is a curved structure with a curved base member 61 which allows the device 60 to be used on a curved vertical surface 12. Curved base member 61, which is design to conform to the curved vertical surface 12, is similar in construction to base member 21 having a curved support member 62 and a connector engagement surface 63. Curved base member 61 may be manufactured in a curved configuration or made of sufficiently flexible material to be manually shaped in the curved configuration during use.

Figure 11:
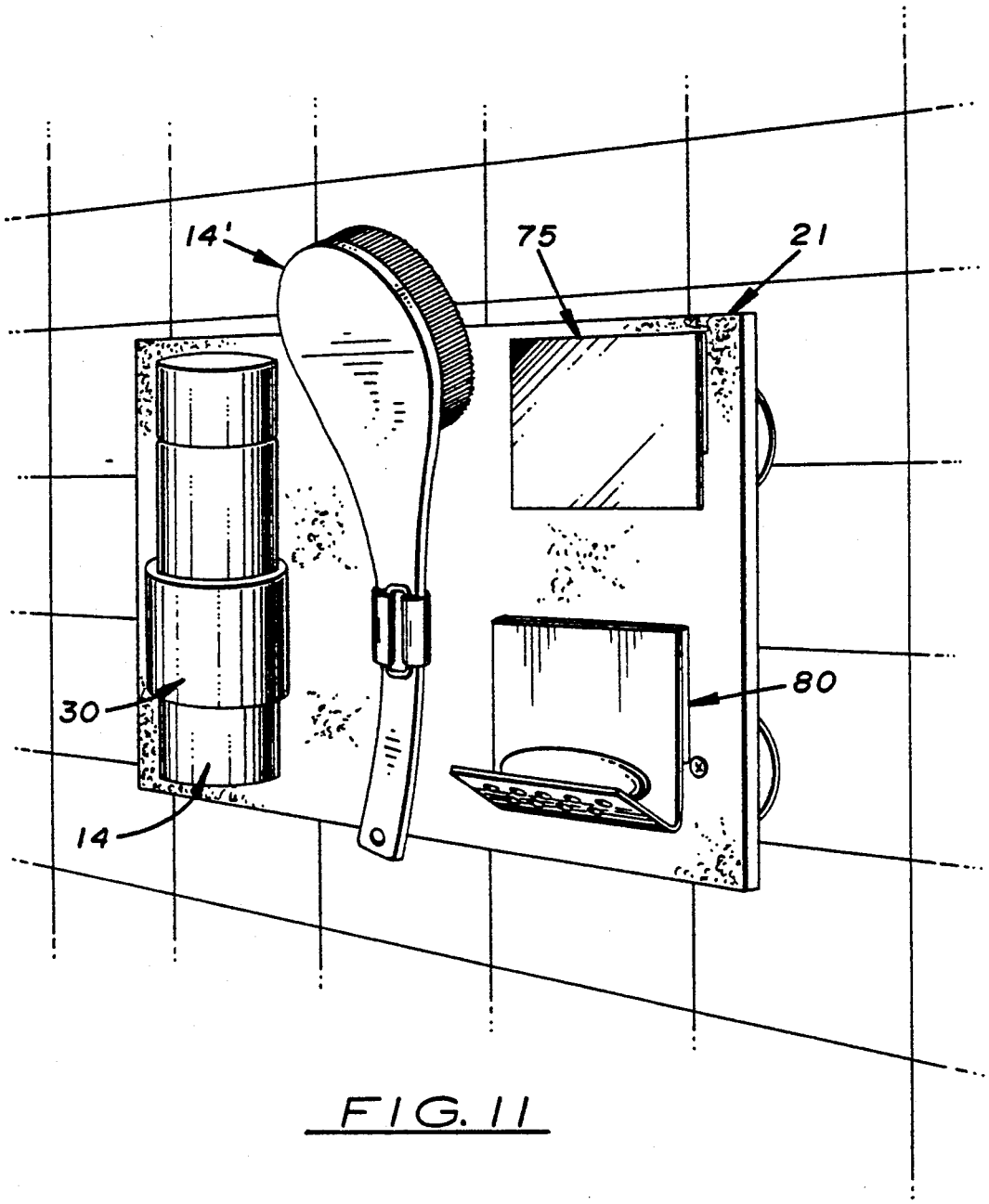
FIG. 11 is a perspective view of an embodiment of the device with optional mirror and soap dish connectors attached to the base member.

In addition to the organizing devices 20, 50, and 60 described above, which use a plurality of strap connectors 30 to removably attach various objects 14 to the base member 21, 51, 61, respectively, an optional mirror connector 75 and a soap dish connector 80, as shown in FIG. 11, may also be used.

Figure 12:
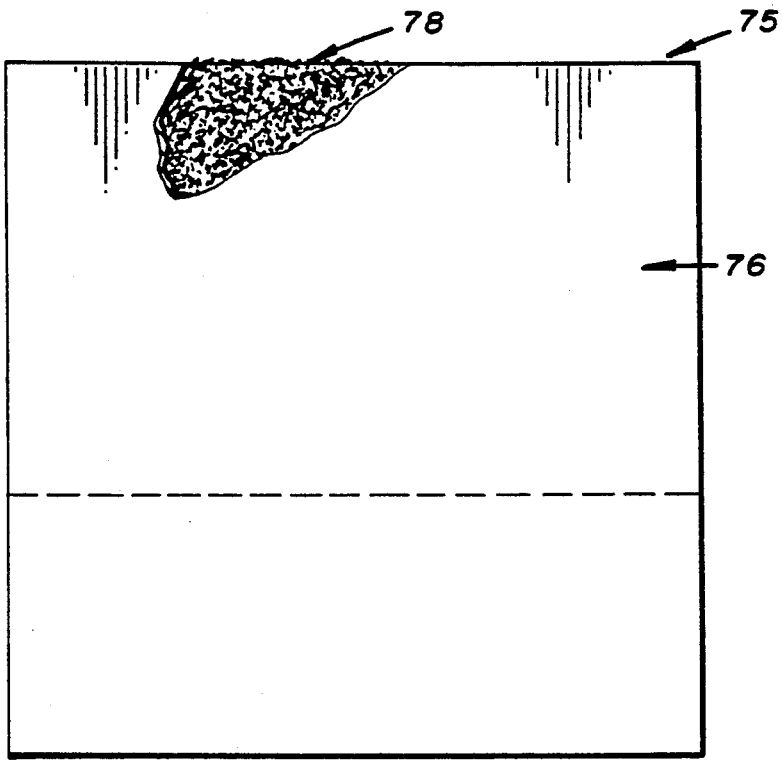
FIG. 12 is plan view of the mirror connector.
Figure 13:
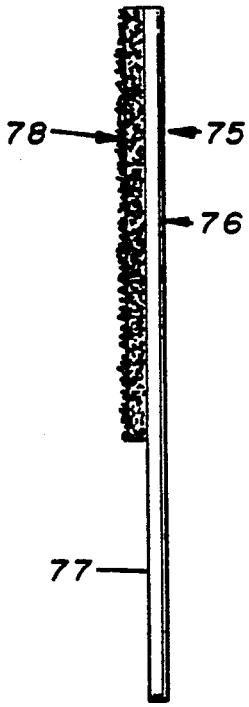
FIG. 13 is a side elevational view of the mirror connector shown in FIG. 12.

As shown in FIGS. 12–13, mirror connector 75 comprises a mirror 76 made of clear, mirrored acrylic material approximately ⅛ inch thick and a hook pad 78, made of nylon hook connector material adhesively attached to the rear surface 77. The hook pad 78 is capable of being interconnected with first loop connector material 26 and removably attached to the base member 21.

Figure 14:
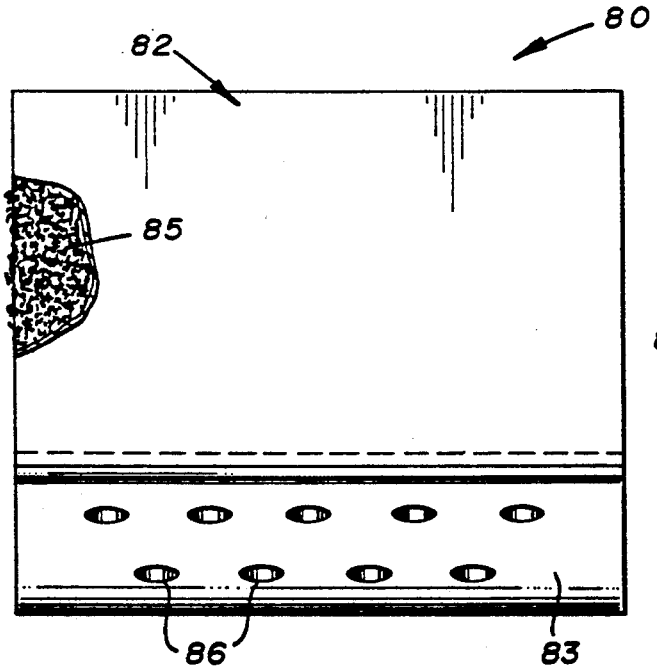
FIG. 14 is a plan view of the soap dish connector.
Figure 15:
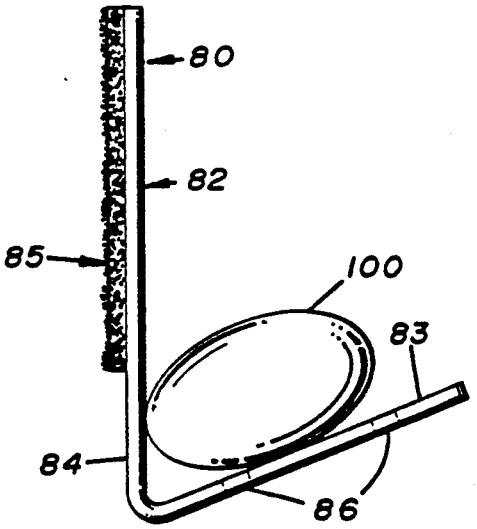
FIG. 15 is a side elevational view of the soap dish connector shown in FIG. 14.

As shown in FIG. 14–15, soap dish 80 includes a support plate 82 made of ABS plastic approximately ⅛ inch thick having an integrally formed leg 83 which projects outward from the support plate 82 to hold a bar of soap 100. A plurality of holes 86 are manufactured in the leg 83 to allow drainage. A hook pad 85, similar to the hook pad 78 used with the mirror connector 75, is adhesively attached to the rear surface 84 of the support plate 83 to removably attach the soap dish 80 to the base member 21.

Using the herein disclosed organizing device, a method of holding and storing objects used in the bath or shower on the vertical surface is disclosed comprising the following steps: (1) attaching the removable base member 21 in the desired position to a vertical surface adjacent to a bathtub or shower; (2) attaching a strap connector 30 around an object 14 to be attached to the base member 21; (3) attaching the object 14 to an open area on the base member 21 by interconnecting the strap connector 30 with the base member; (4) repeating steps 2 and 3 until all of the desirable objects 14 are attached to the base member 21 or until the supporting limit of the base member 21 is met, and; (5) selectively using an object attached to the base member by removing and then reconnecting the strap connector attached to the object to the base member.

Additional steps in the method cited above include attaching a mirror and soap dish connector 75 and 80 respectively, to the base member 21.

In compliance with the statute, the invention has been described in language more or less specific as to the elements or steps required to practice the invention. It is understood, however, that the invention is not limited to the elements or steps described herein, since they describe the preferred manner of putting the invention into practice. The invention is therefore, claimed in any of its forms or modifications within the legitimate and valid scope of the appended claims properly interpreted in accordance with the doctrine of equivalents.

INDUSTRIAL APPLICABILITY

As stated above, the invention disclosed herein is particularly well suited for use in the bathroom or shower areas. The invention also will have wide spread use other in industries where objects must be held on vertical surfaces, such as the shelving or article supporting industries.

| REFERENCE NUMBERS | |
|---|---|
| 1. | |
| 2. | |
| 3. | |
| 4. | |
| 5. | |
| 6. | |
| 7. | |
| 8. | |
| 9. | |
| 10. | wall (generally) |
| 11. | angled corner |
| 12. | curved wall |
| 13. | |
| 14. | container objects |
| 14'. | miscellaneous other objects |
| 15. | shampoo container |
| 16. | self-dispensing lids |
| 17. | |
| 18. | |
| 19. | |
| 20. | device |
| 21. | base member |
| 22. | support member |
| 23. | |
| 24. | |
| 25. | foam material |
| 26. | first loop connector surface |
| 27. | suction cups |
| 28. | |
| 29. | threaded connectors |
| 30. | strap connectors |
| 31. | wrap structure |
| 32. | inside surface of wrap structure |
| 33. | outside hook connector surface |
| 34. | first end of wrap structure |
| 35. | second end of wrap structure |
| 36. | strip |
| 36a | distal end |
| 37. | second loop connector surface |
| 38. | space |
| 39. | ring |
| 39(a). | first leg |
| 39(b) | second leg |
| 40. | passageway |
| 41. | |
| 42. | |
| 43. | |
| 44. | |
| 45. | |
| 46. | |
| 47. | |
| 48. | |
| 49. | |
| 50. | 2nd embodiment of device |

-continued

| REFERENCE NUMBERS | |
|---|---|
| 51. | angled base member of 2nd embodiment |
| 52. | first planar section |
| 53. | second planar section |
| 54. | joint |
| 55. | |
| 56. | |
| 57. | |
| 58. | |
| 59. | |
| 60. | 3rd embodiment of device |
| 61. | curved base member of 3rd. embodiment |
| 62. | |
| 63. | connector engagement surface |
| 64. | |
| 65. | |
| 66. | |
| 67. | |
| 68. | |
| 69. | |
| 70. | |
| 71. | |
| 72. | |
| 73. | |
| 74. | |
| 75. | mirror connector |
| 76. | mirror |
| 77. | rear surface of mirror |
| 78. | hook pad |
| 79. | |
| 80. | soap dish connector |
| 81. | |
| 82. | support plate |
| 83. | leg |
| 84. | rear surface of support plate |
| 85. | hook pad |
| 86. | holes |
| 87. | |
| 88. | |
| 89. | |
| 90. | |
| 91. | |
| 92. | |
| 93. | |
| 94. | |
| 95. | |
| 96. | |
| 97. | |
| 98. | |
| 99. | |
| 100. | bar of soap |

We claim:

1. A vertical surface organizing device, comprising:

a. a base member, said base member including an inner, semi-rigid support member covered by a connector engagement surface, said connector engagement surface including of foam material covered by a first loop connector surface;

b. a surface attachment means attached to said inside surface of said base member, said surface attachment means being capable of allowing said base member to be selectively attached to a vertical surface without causing damage thereto, and sufficiently attaching said base member to said vertical surface while a plurality of objects are attached and detached from said base member, and;

c. a plurality of object connectors, each said object connector being capable of selectively attaching to an object to attached to said base member, each said object connector being capable of selectively attached to said connector engagement surface on said base member, thereby enabling said object to be selectively and attached to said base member.

2. A device as recited in claim 1, wherein said surface attachment means is plurality of suction cups capable of selectively attaching and holding said base member on said vertical surface during use.

3. A device as recited in claim 2, wherein said object connectors comprises; a strap connector including a wrap structure having an outside hook connector surface, an inside surface, a first end, and a second end, said outside hook connector surface capable of being interconnected with said first loop connector surface located on said base member, a strip attached to said second end of said wrap structure and having a second loop connector surface, and an adjustment means attached to said wrap structure enabling said strap connector to be adjustably attached to different said objects.

4. A device as recited in claim 3, wherein said adjustment means is a ring structure having a central passageway.

5. A device as recited in claim 4, wherein said base member is a planar structure.

6. A device as recited in claim 4, wherein said base member is an angled structure.

7. A device as recited in claim 4, wherein said base member is a curved structure.

8. A device as recited in claim 4, further including a mirror connector.

9. A device as recited in claim 5, further including soap dish connector.

10. A bathroom or shower stall vertical surface organizing device, comprising:

a. a base member capable of being selectively attached to a vertical surface, said base member having a semi-rigid support member with an inside surface, said base member having an connector engagement surface with an outer, first loop connector surface;

b. a plurality of suction cups attached to said inside surface of support member, said suction cups being capable of attaching said base member to said vertical surface during use, and;

c. a plurality of strap connectors having a hook connector surface capable of being selectively attached to said first loop connector surface on said base member during use, each said strap connector being capable of adjustably attached to an object to be used, thereby enabling said user to selectively attach a plurality of objects to said base member.

11. A device as recited in claim 10, wherein said strap connector includes a wrap structure having an adjustment means attached thereto enabling said strap connector to be adjustably attached to a plurality of different said objects.

12. A device as recited in claim 11, wherein said base member is a planar structure.

13. A device as recited in claim 12, further including a soap dish connector capable of being attached to said base member.

14. A device as recited in claim 13, further including a mirror connector capable of being attached to said base member.

15. A device as recited in claim 11, wherein said base member has an angled structure including a first and second planar sections attached together at a joint.

16. A device as recited in claim 11, wherein said base member is a curved structure.

17. A method of organizing objects used in a bath or shower on a vertical surface comprising the following steps:

a. attaching a removable base member having a connector engagement surface in the desired location on said vertical surface, said base member having a plurality of suction cups attached to the inside surface of the base member capable of being selective attached to said vertical surface;

b. adjustably attaching one strap connector around one said object to be used in said bath or shower;

c. selectively attaching said strap connector to said connector engagement surface on said base member to attached said object on said base member, and;

d. repeating steps b and c until all of said objects to be used in said bath or shower are attached to said base member, and;

e. selectively using said objects attached to said base member by removing and then reconnecting said strap connector attached to said object to said base member.

18. A method, as recited in claim 17, further including step f) attaching a mirror connector and a soap dish connector to said base member.

* * * * *